US007513312B2

(12) United States Patent
Carriere et al.

(10) Patent No.: US 7,513,312 B2
(45) Date of Patent: Apr. 7, 2009

(54) DRILLING RIG APPARATUS AND DOWNHOLE TOOL ASSEMBLY SYSTEM AND METHOD

(75) Inventors: Gene Carriere, Medicine Hat (CA); Don Goldade, Medicine Hat (CA)

(73) Assignee: Savanna Energy Services Corp., Calgary, Alberta (CA)

( * ) Notice: Subject to any disclaimer, the term of this patent is extended or adjusted under 35 U.S.C. 154(b) by 0 days.

(21) Appl. No.: 11/706,542

(22) Filed: Feb. 15, 2007

(65) Prior Publication Data

US 2007/0144745 A1 Jun. 28, 2007

Related U.S. Application Data

(63) Continuation of application No. 11/226,000, filed on Sep. 14, 2005, now Pat. No. 7,191,839, which is a continuation of application No. 10/690,749, filed on Oct. 23, 2003, now Pat. No. 6,973,979.

(60) Provisional application No. 60/462,738, filed on Apr. 15, 2003.

(51) Int. Cl.
*E21B 3/00* (2006.01)
*E21B 19/22* (2006.01)

(52) U.S. Cl. ..... 166/379; 166/77.2; 166/77.51

(58) Field of Classification Search ..... 175/203, 175/162, 122; 166/77.1–77.3, 379, 385, 166/384

See application file for complete search history.

(56) References Cited

U.S. PATENT DOCUMENTS 3,042,377 A 7/1962 Woolslayer et al.
3,464,507 A 9/1969 Smith et al.
3,734,210 A 5/1973 Wilderman
4,265,304 A 5/1981 Baugh
4,515,220 A * 5/1985 Sizer et al. ..... 166/384
5,735,351 A * 4/1998 Helms ..... 166/384
5,809,916 A * 9/1998 Strand ..... 166/77.2
5,842,530 A 12/1998 Smith et al.
5,975,207 A 11/1999 Smitherman
6,003,598 A 12/1999 Andreychuk
6,065,550 A 5/2000 Gardes
6,158,516 A 12/2000 Smith et al.
6,273,188 B1 8/2001 McCafferty et al.
6,332,501 B1 12/2001 Gipson
6,431,286 B1 8/2002 Andreychuk (Continued)

FOREIGN PATENT DOCUMENTS

CA 2189376 2/1999

(Continued)

*Primary Examiner*—Kenneth Thompson
(74) *Attorney, Agent, or Firm*—Bracewell & Giuliani LLP

(57) ABSTRACT

A drilling rig is provided which is adapted to selectively drill using coiled tubing and jointed-pipe. The rig includes a base, a mast, a top drive slidably mounted to said mast for performing jointed-pipe operations, and a tubing injector for performing coiled tubing operations, mounted on said mast for selective movement from a first position in which the injector is in line with the mast and a second position in which the injector is out of line with the mast to permit jointed-pipe operations by the top drive. The rig is uniquely suited to easily and quickly assemble bottom hole assemblies (BHA's), and to connect such BHA's to coiled tubing.

35 Claims, 11 Drawing Sheets

U.S. PATENT DOCUMENTS

| | | | | |
|---|---|---|---|---|
| 6,502,641 | B1 | 1/2003 | Carriere et al. | |
| 6,609,565 | B1 | 8/2003 | Andreychuk et al. | |
| 6,668,684 | B2 | 12/2003 | Allen et al. | |
| 6,901,998 | B1 * | 6/2005 | Roodenburg et al. | 166/85.1 |
| 6,973,979 | B2 * | 12/2005 | Carriere et al. | 175/203 |
| 7,182,140 | B2 * | 2/2007 | Wood | 166/379 |
| 7,185,708 | B2 * | 3/2007 | Wood et al. | 166/379 |
| 7,191,839 | B2 * | 3/2007 | Carriere et al. | 166/379 |
| 2003/0079883 | A1 | 5/2003 | McCulloch et al. | |
| 2003/0098150 | A1 | 5/2003 | Andreychuk | |

FOREIGN PATENT DOCUMENTS

| | | |
|---|---|---|
| CA | 2292214 | 12/1999 |
| CA | 2298089 | 2/2000 |
| CA | 2235555 | 9/2000 |
| CA | 2322916 | 10/2000 |
| CA | 2332420 | 1/2001 |
| CA | 2364147 | 5/2003 |
| CA | 2322917 | 1/2007 |
| US | 2419650 | 2/2002 |

* cited by examiner

DRILLING RIG APPARATUS AND DOWNHOLE TOOL ASSEMBLY SYSTEM AND METHOD

CROSS-REFERENCE TO RELATED APPLICATIONS

This application is a continuation of Ser. No. 11/226,000, filed Sep. 14, 2005 now U.S. Pat. No. 7,191,839, which is a continuation of Ser. No. 10/690,749, filed Oct. 23, 2003, U.S. Pat. No. 6,973,979, which claims the benefit of U.S. Provisional Application filed Apr. 15, 2003 under No. 60/462,738 which is incorporated herein in its entirety.

FIELD OF THE INVENTION

The invention relates to oil and gas drilling rigs, and in particular oil and gas drilling rigs used to drill using both coiled tubing and jointed-pipe.

BACKGROUND OF THE INVENTION

The use of coiled tubing (CT) technology in oil and gas drilling and servicing has become more and more common in the last few years. In CT technology, a continuous pipe wound on a spool is straightened and pushed down a well using a CT injector. CT technology can be used for both drilling and servicing.

The advantages offered by the use of CT technology, including economy of time and cost are well-known. As compared with jointed-pipe technology wherein typically 30-45 foot straight sections of pipe are connected one section at a time while drilling the well bore, CT technology allows the continuous advancement of piping while drilling the well significantly reducing the frequency with which such drilling must be suspended to allow additional sections of pipe to be connected. This results in less downtime, and as a result, an efficiency of both cost and time.

However, the adoption of CT technology in drilling has been less widespread than originally anticipated as a result of certain problems inherent in using CT in a drilling application. For example, because CT tends to be less robust than jointed-pipe for surface-level drilling, it is often necessary to drill a pilot hole using jointed-pipe, cement casing into the pilot hole, and then switch over to CT drilling. Additionally, when difficult formations such as boulders or gravel are encountered down-hole, it may be necessary to switch from CT drilling to jointed-pipe drilling until the formation is overcome, and then switch back to CT drilling to continue drilling the well. Similarly, when it is necessary to perform drill stem testing to assess conditions downhole, it may again be necessary to switch from CT drilling to jointed-pipe drilling and then back again. Finally, a switch back to jointed-pipe operations may be necessary to run casing into the drilled well. These types of situations require the drilling manager to switch back and forth between CT drilling rigs and jointed-pipe drilling rigs, a process which results in significant downtime as one rig is moved out of the way, and another rig put in place.

Another disadvantage of CT drilling is the time-consuming process of assembling a BHA (bottom-hole-assembly—the components at the end of the CT for drilling, testing, etc.), and connecting the BHA to the end of the CT. Presently, this step is performed manually through the use of rotary tables and make/breaks. Not only does this process result in costly down-time, but it can also present safety hazards to the workers as they are required to manipulate heavy components manually.

SUMMARY OF THE INVENTION

This invention provides an improved rig for drilling oil and gas wells. The rig includes components which permit both coiled tubing and jointed-pipe drilling with a minimum of steps and time required to switch between the two. The setup of the rig also allows the easy and time-efficient assembly of bottom hole assemblies (BHA's), and their connection to coiled tubing.

In a broad aspect, the present invention provides a rig for drilling a well, comprising a base, a mast mounted on said base, a top drive operable to engage and rotate downhole equipment slidably mounted on said mast for longitudinal sliding along said mast, and a coiled tubing injector operable to move coiled tubing in and out of said well mounted on said mast such that the coiled tubing injector may be selectively transposed between a first position in which the injector is in line with the mast, to a second position in which the injector is out of line with the mast to accommodate manipulation of down-hole equipment by the top drive.

In another aspect, the present invention provides a BHA (bottom hole assembly) assembling system for assembling a BHA for use in coiled tubing drilling, said BHA assembling system comprising a base, a mast mounted on said base, a top drive operable to engage and rotate BHA elements slidably mounted on said mast for longitudinal sliding along said mast, a coiled tubing injector operable to move coiled tubing on to and off of a BHA mounted on said mast such that the coiled tubing injector may be selectively transposed between a first position in which the injector is in line with the mast, to a second position in which the injector is out of line with the mast to accommodate manipulation of BHA elements by the top drive, and a rotary table operable to engage and rotate BHA elements, mounted on said base in line with the mast.

In a further aspect, the present invention provides a method of assembling a plurality of threaded BHA (bottom hole assembly) elements into a BHA for use in coiled tubing drilling, each of said BHA elements having an upper end and a lower end. The method uses a BHA assembling system having a base, a mast mounted on said base, a top drive operable to engage and rotate BHA elements slidably mounted on said mast for longitudinal sliding along said mast, a coiled tubing injector operable to move coiled tubing on to and off of a BHA mounted on said mast such that the coiled tubing injector may be selectively transposed between a first position in which the injector is in line with the mast, to a second position in which the injector is out of line with the mast to accommodate manipulation of BHA elements by the top drive, and a rotary table mounted on said base in line with the mast, operable to engage and rotate BHA elements. This method comprises:

a) transposing the coiled tubing injector to its second position in which the injector is out of line with the mast;
b) sliding the top drive to a position along the mast in spaced relation to the rotary table;
c) placing a bottom element of the BHA into the rotary table;
d) operating the rotary table to engage the bottom element of the BHA;
e) placing a second element of the BHA such that its upper end is adjacent to the top drive;
f) operating the top drive to engage the second element of the BHA;
g) positioning the second element such that its lower end is adjacent to the upper end of the bottom element of the BHA;

h) operating said top drive and/or said rotary table to rotate the second element and/or the bottom element relative to each other so as to screw the two elements together;

i) operating the top drive to disengage the second element of the BHA;

j) sliding the top drive along the mast to a position in spaced relation to the second element;

k) repeating steps e) through j) for the remaining elements of the BHA;

l) sliding the top drive along the mast to a position above the coiled tubing injector;

m) transposing said coiled tubing injector to its first position in which the injector is in line with the mast;

n) operating said coiled tubing injector to move coiled tubing having a threaded end, to a position adjacent the assembled BHA;

o) operating said rotary table to rotate the BHA so as to screw the BHA onto said threaded end of the coiled tubing; and p) operating said rotary table to disengage the BHA.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
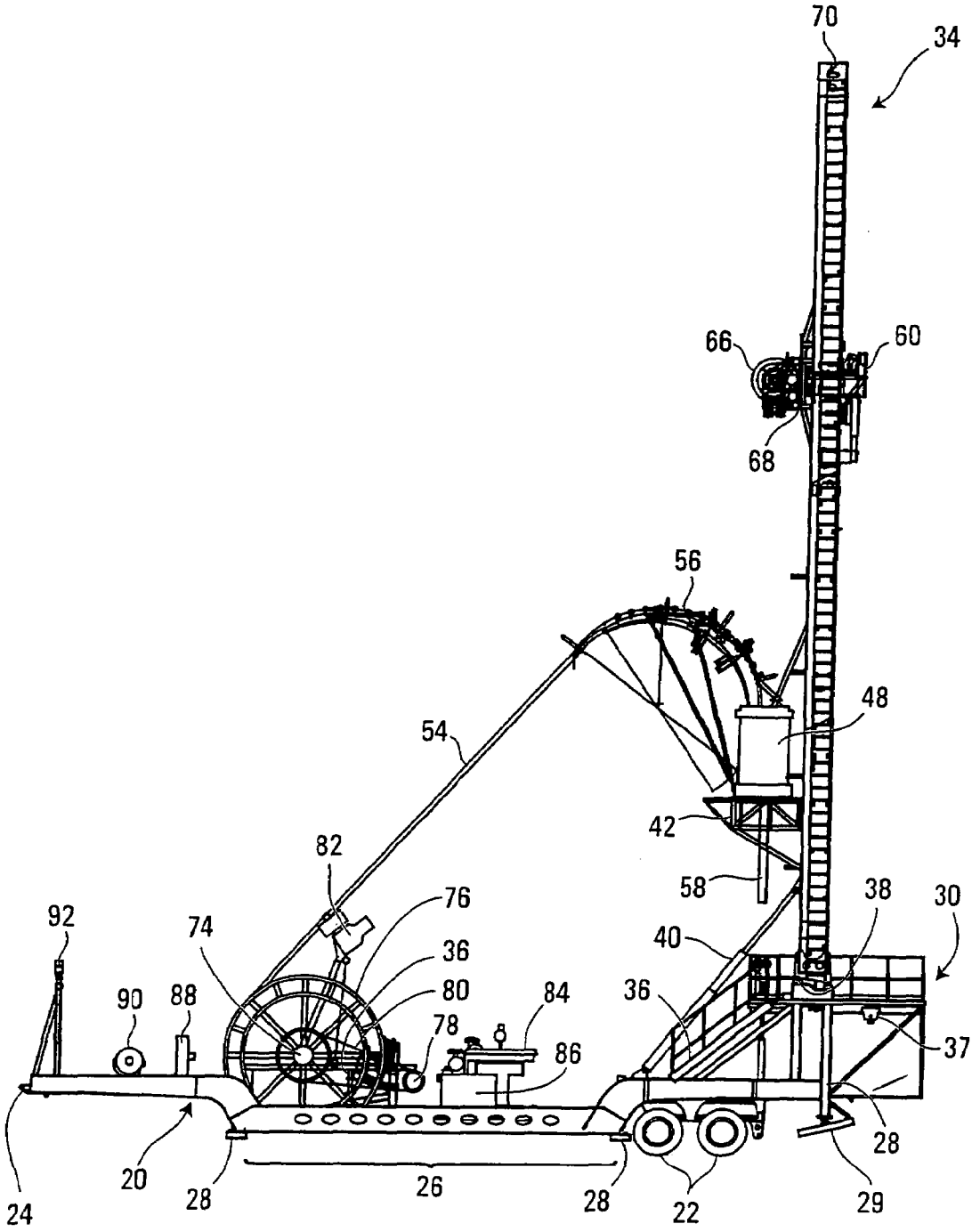
FIG. 1 is a side view of a preferred embodiment of the rig of the present invention shown in jointed-pipe drilling mode.
Figure 2:
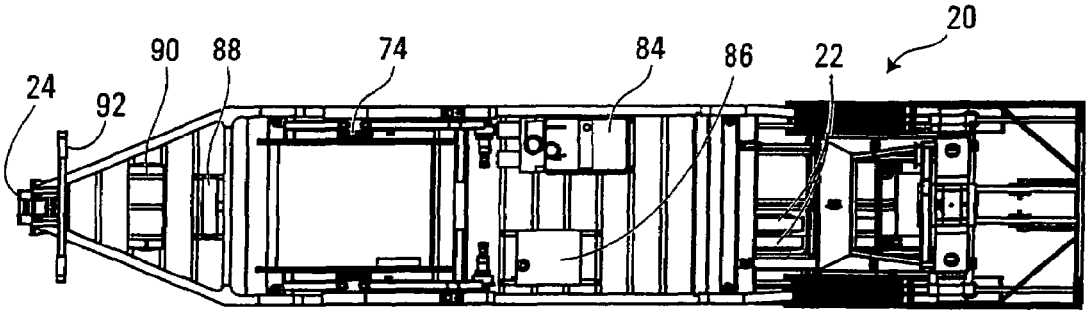
FIG. 2 is a top view of a trailer of the rig of FIG. 1.
Figure 3:
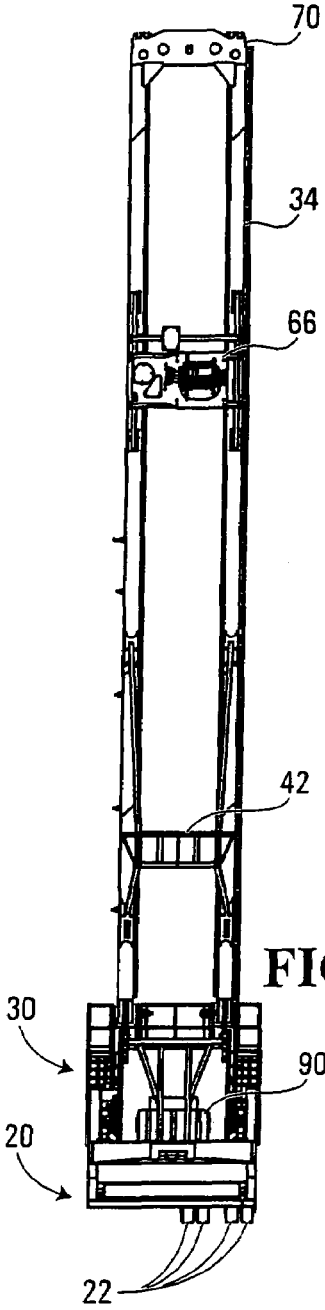
FIG. 3 is a front view of the rig of FIG. 1.
Figure 4:
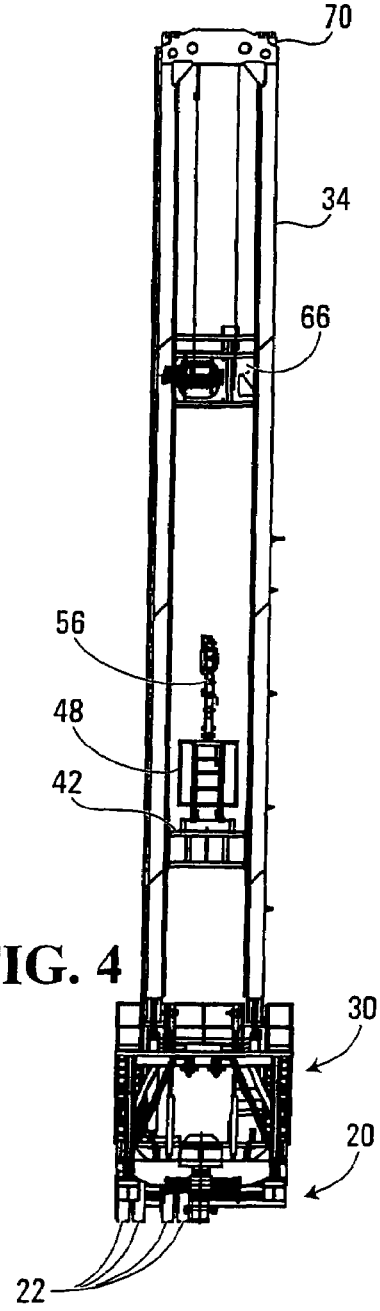
FIG. 4 is a rear view of the rig of FIG. 1.

A preferred embodiment of the rig of the present invention is shown in the attached drawings. Its basic features are shown in FIG. 1.

In a broad sense, this rig includes a base, a mast, and drilling components.

In this preferred embodiment, the base is a wheeled carrier or trailer 20 which is adapted to be pulled by a motorized vehicle. The trailer 20 has wheels 22 located near its rear, and a hitch 24 located near its front for attachment to a motorized vehicle (not shown). The trailer 20 also has a lowered middle portion 26 so as to lower the center of gravity of the components placed on this portion of the trailer 20. While the wheeled carrier of the preferred embodiment rig has been described and illustrated as being one which is adapted to be pulled by a motorized vehicle, it is to be understood that the wheeled carrier may itself be self-propelled.

The trailer 20 has mounted thereon retractable outriggers or stabilizer legs 28 for stabilizing and levelling the rig for drilling. Three stabilizer legs 28 are located on each side of the rig, at the front of the lowered middle portion 26, the rear of the lowered middle portion 26 and at the rear of the trailer 20. The stabilizer legs 28 have pontoons 29 mounted at their ends to ensure positive contact with the ground. In the preferred embodiment rig, a single long pontoon is attached to the front two legs 28 on each side of the rig, while a shorter pontoon is attached to the rear leg 28 on each side.

Figure 11:
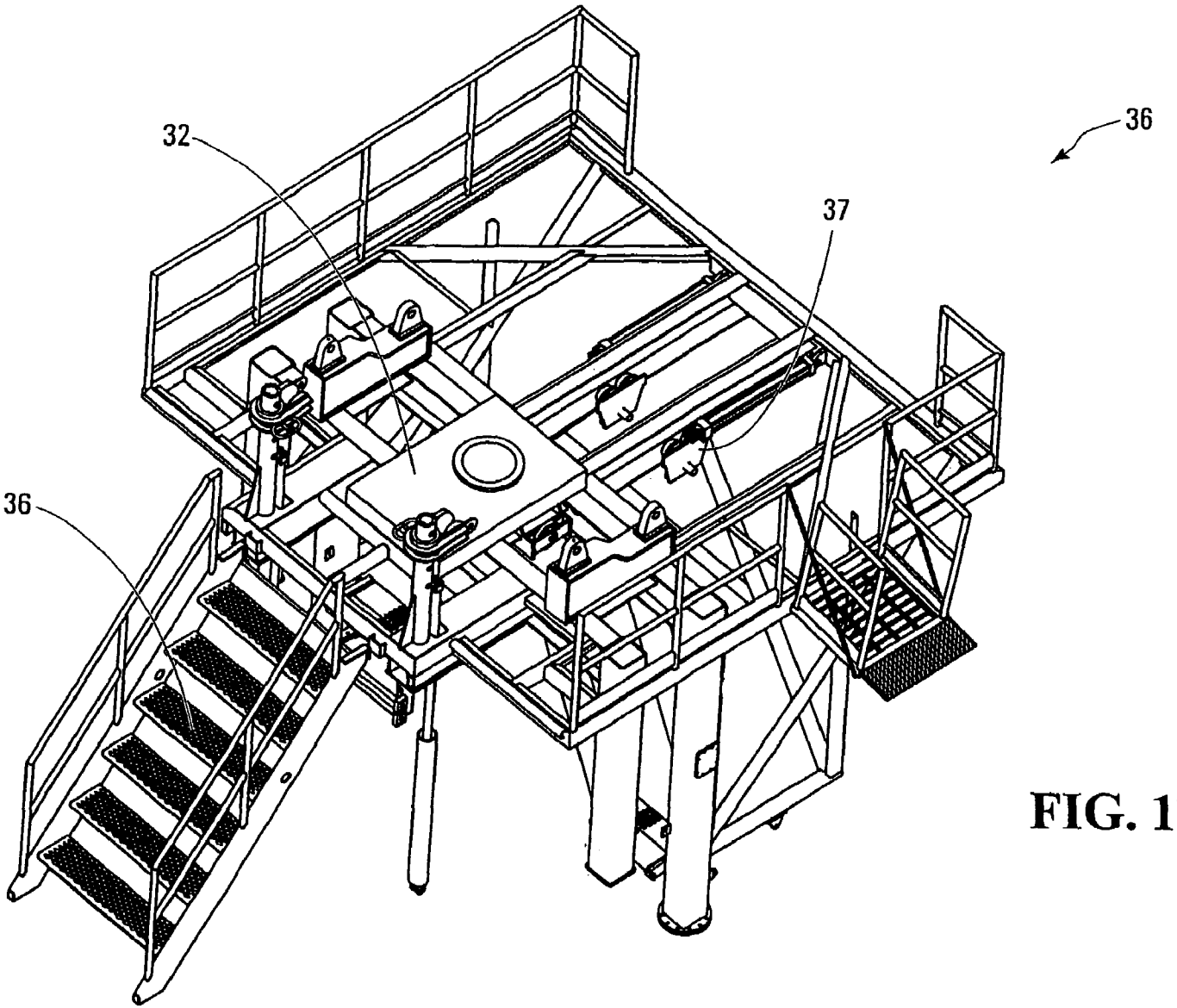
FIG. 11 is a top perspective view of a substructure of the rig of FIG. 1.

Near the rear of the trailer is mounted a drilling substructure 30, essentially a raised platform supporting a rotary table 32, as seen in FIG. 11, and a mast 34. Stairs 36 are attached to the substructure 30 to allow workers to ascend to the substructure 30.

The rotary table 32 is a collar adapted to engage down-hole equipment including tubing (coiled tubing or jointed-pipe for example) through the use of slips or wedges 33 (FIGS. 13, 14), and which is hydraulically powered for rotation. The rotary table 32 is used to engage and rotate (or prevent rotation of) equipment inserted therein. The substructure 30 also has mounted thereon BOP hangers 37 below the rotary table 32 to allow raising and lowering of BOP's (blow-out preventers) off of, and onto a wellhead.

Figure 7:
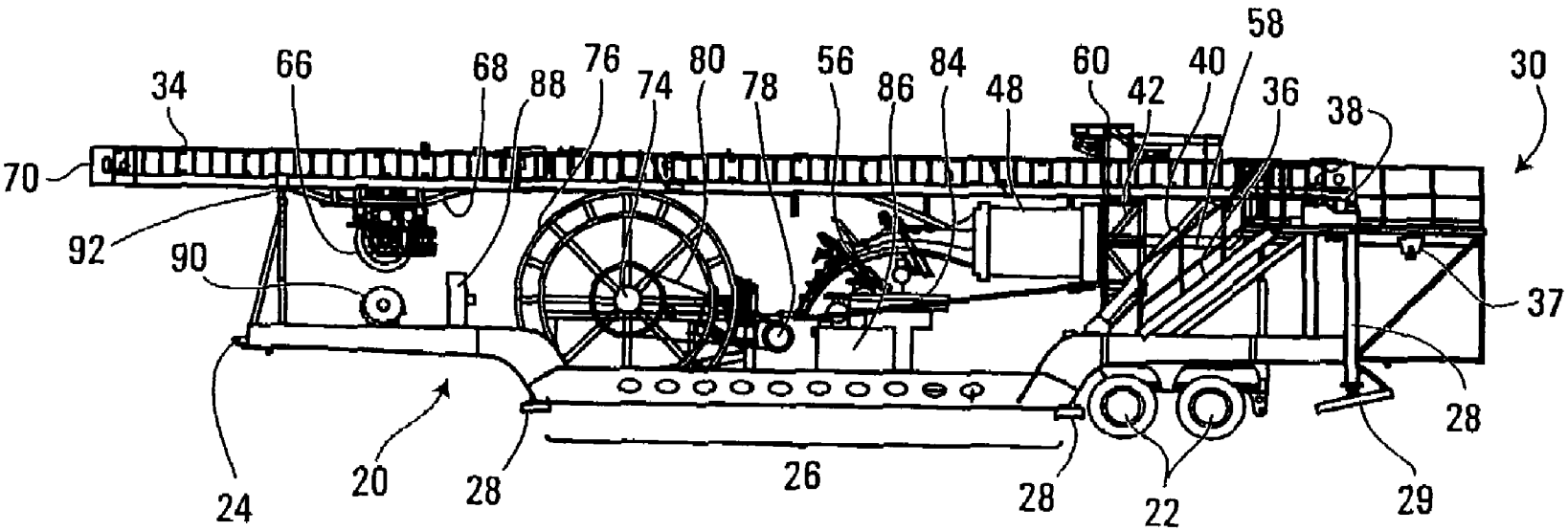
FIG. 7 is a side view of the rig of FIG. 1 shown in transportation mode.

The mast 34 is pivotally attached to the substructure 30 at mast mounting pins 38 for pivotal movement between a horizontal transportation position as shown in FIG. 7, and a vertical operating position as shown in FIG. 1. Although not illustrated, the rig could be modified such that the mast 34 could also operate at any operating angle in between the horizontal and vertical position to permit off-vertical drilling. Such modifications would include providing a support for the mast at off-vertical angles, and modifying the placement of the rotary table 32 and BOP hangers 37 to accommodating tilting of these elements with the mast. The vertical/horizontal orientation of the mast is controlled by a hydraulic cylinder 40 connected at its ends to the trailer 20 and the mast 34.

Figure 10:
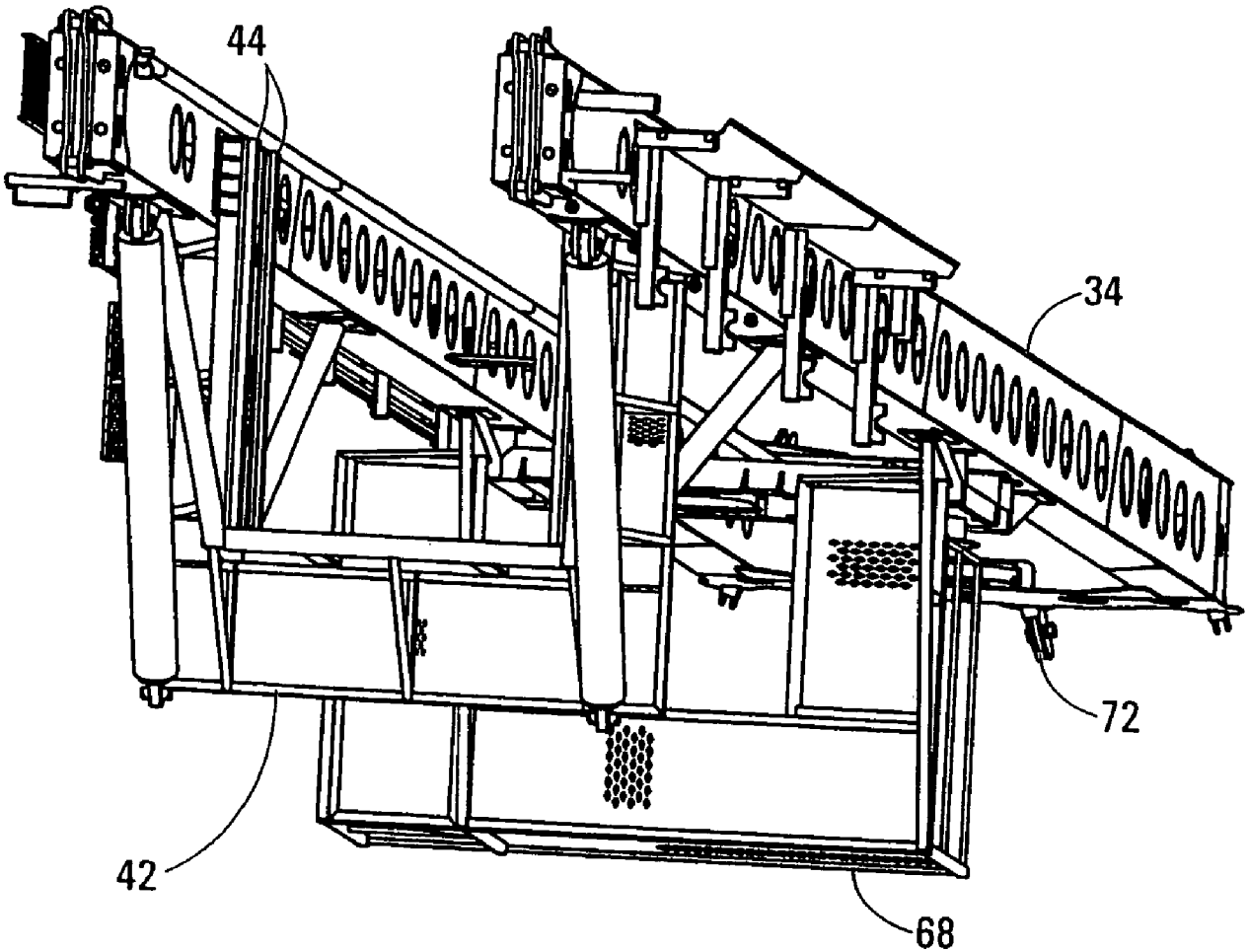
FIG. 10 is a bottom perspective view of the mast of the rig of FIG. 1.

A coiled tubing injector platform 42 is mounted on the front of the mast 34 near the point at which the mast 34 is pivotally attached to the substructure 30, in the preferred embodiment at about 12 feet up the mast 34. Forming part of the injector platform 42 are two sets of v-rails 44 (one set shown in FIG. 10) extending substantially perpendicularly from the mast 34. These v-rails 44 are located on either side of the interior of the injector platform 42.

Figure 8:
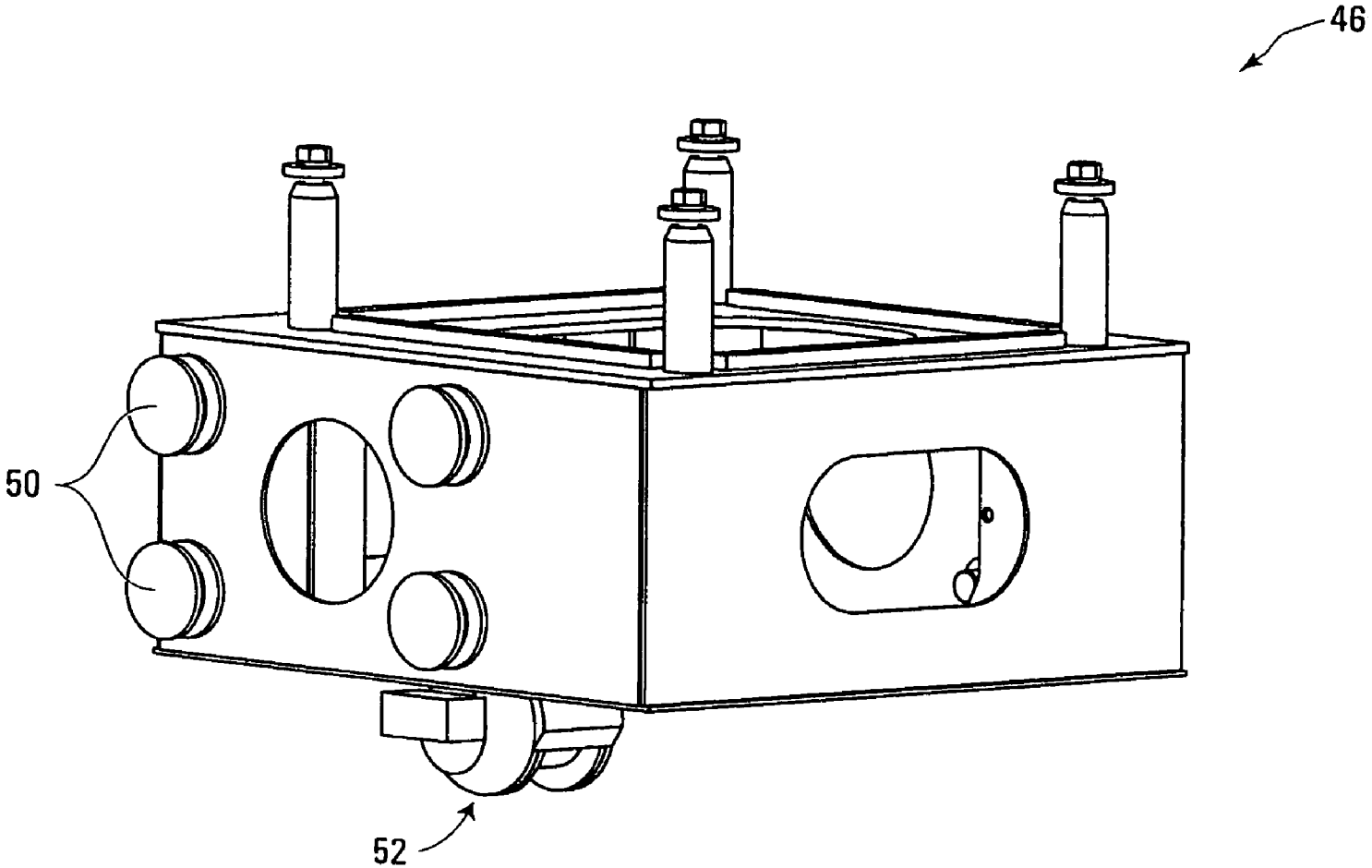
FIG. 8 is a perspective view of an injector dolly of the rig of FIG. 1.
Figure 9:
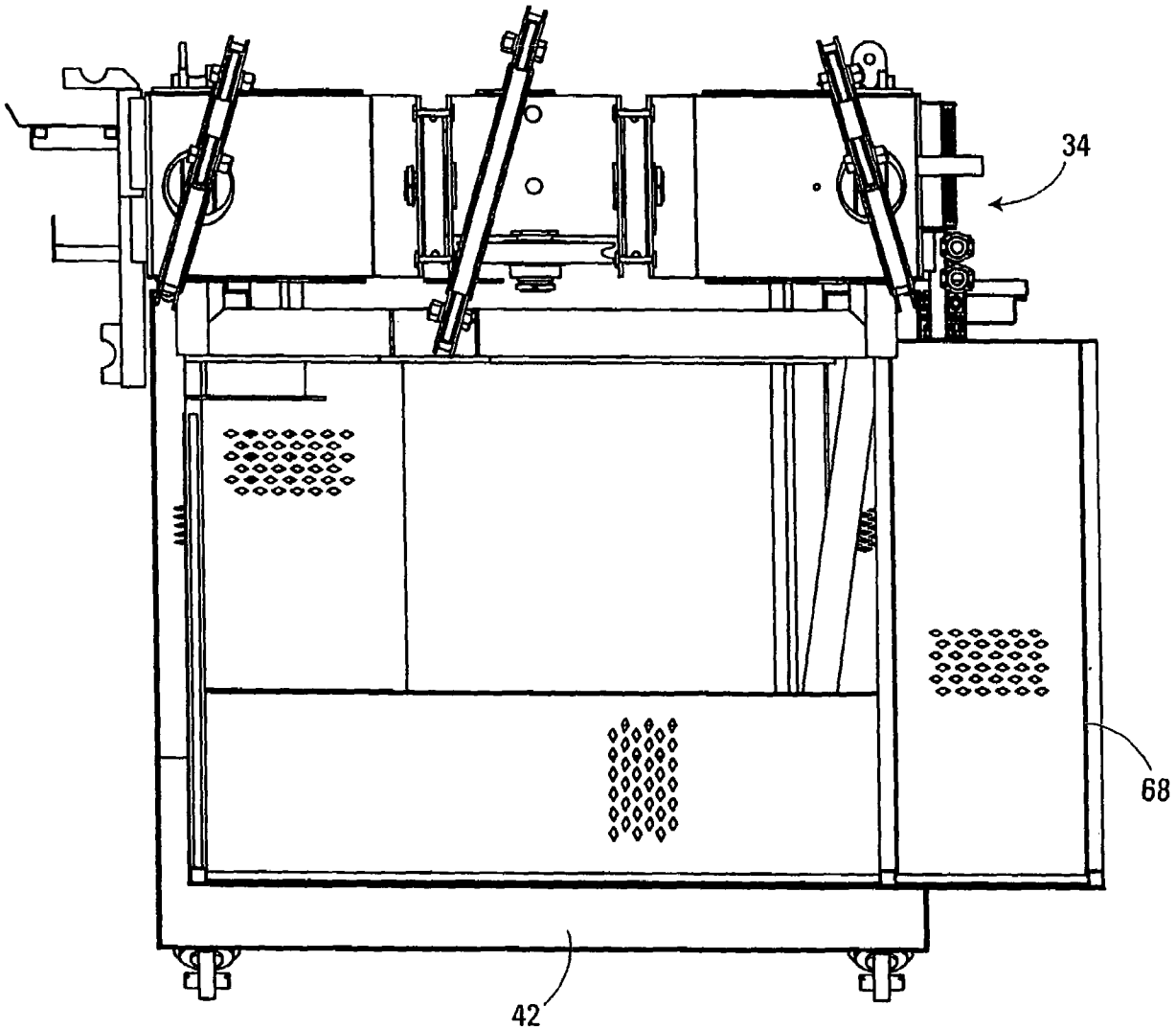
FIG. 9 is a top view of a mast of the rig of FIG. 1.

Riding on these v-rails 44 is an injector dolly 46 (shown in detail in FIG. 8). The injector dolly is a box-shaped component having mounts for receiving a coiled tubing injector 48, and four v-groove rollers 50 located on either side for riding on the v-rails 44 of the injector platform 42. Located below the injector dolly 46 is a lubricator winch 52 whose purpose is discussed in greater detail below. The movement of the injector dolly 46 on the v-rails 44 is controlled by injector hydraulic cylinders (not shown) connected at their ends to the injector dolly 46 and the injector platform 42. The injector hydraulic cylinders are used to selectively move the injector dolly 46 and the coiled tubing injector 48 mounted thereon between a first position in which the injector is in line with the mast 34, and a second position in which the injector 48 is out of line with the mast 34 so as to allow other componentry to use the mast 34, as discussed further below.

The coiled tubing injector 48 is mounted atop the injector dolly 46 and consists of a series of rollers and guides (not shown in detail) used to push, pull and guide coiled tubing 54 into and out of the well. The structure and functionality of coiled tubing injectors are well known and will not be discussed in detail herein. Extending from the top of the injector 48 is an injector arch 56 used to guide the coiled tubing 54 in a gentle arch prior to entry into the injector 48. Extending below the injector 48 is a telescoping lubricator 58 which serves to guide the coiled tubing 54 as it exits the injector 48. The lubricator 58 is telescoping to permit access to the coiled tubing 54 during connection/disconnection with a bottom hole assembly 59 (FIGS. 13, 14) as further discussed below. The lubricator 58 is extended or contracted by the lubricator winch 52 located below the injector dolly 46.

In the preferred embodiment rig of the present invention, the coiled tubing injector 48 is fixed along the mast, rather than slidable along said mast. A fixed injector 48 results in a reduction in cost, simplicity of design and operation, reduction in weight, ease of collapsibility of the mast 34 into transportation position, and safety during transportation. It is to be understood however, that a sliding injector 48 may also be used in accordance with other embodiments of the present invention.

Figure 5:
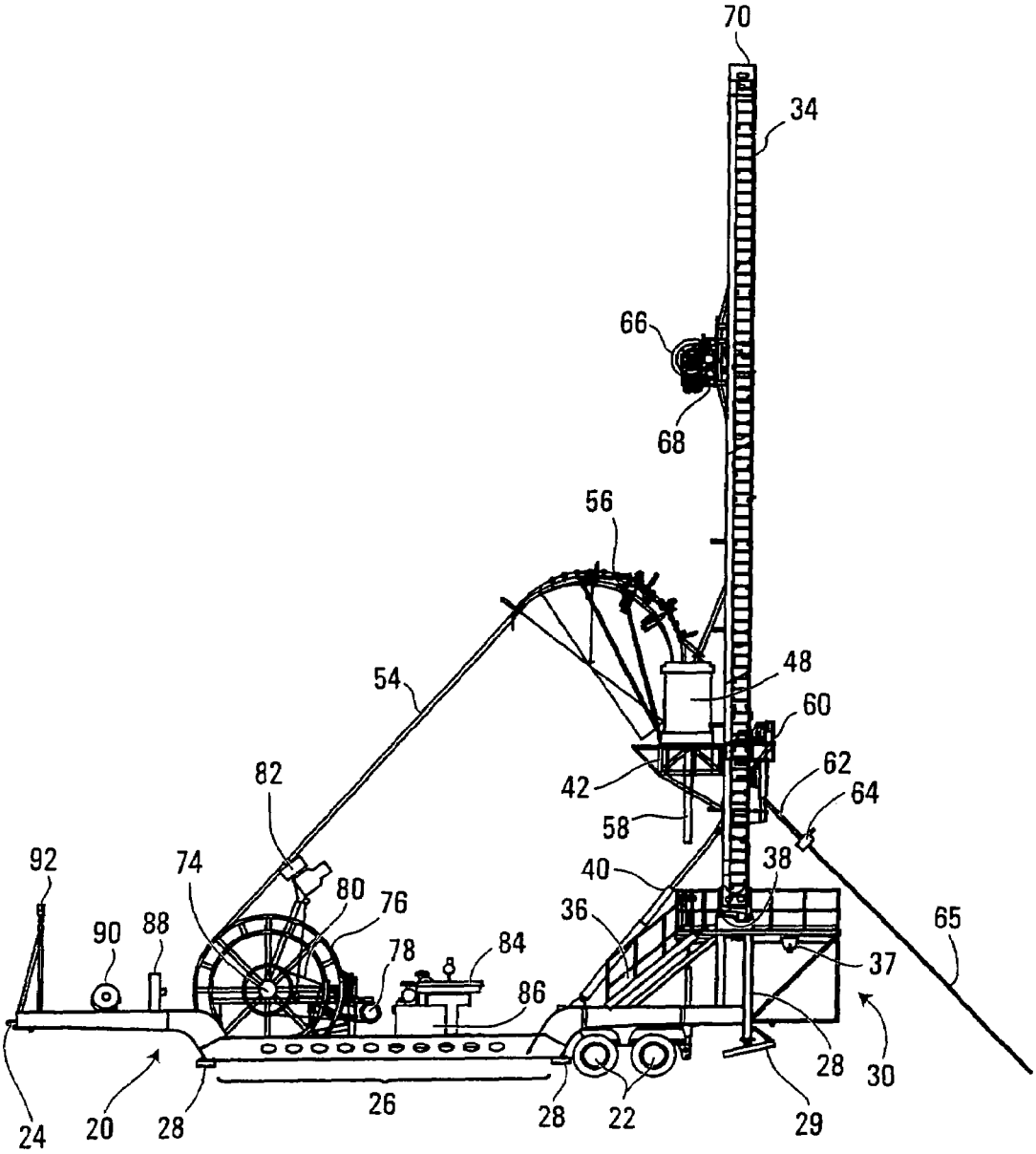
FIG. 5 is a side view of the rig of FIG. 1 shown in jointed-pipe pick-up mode.
Figure 6:
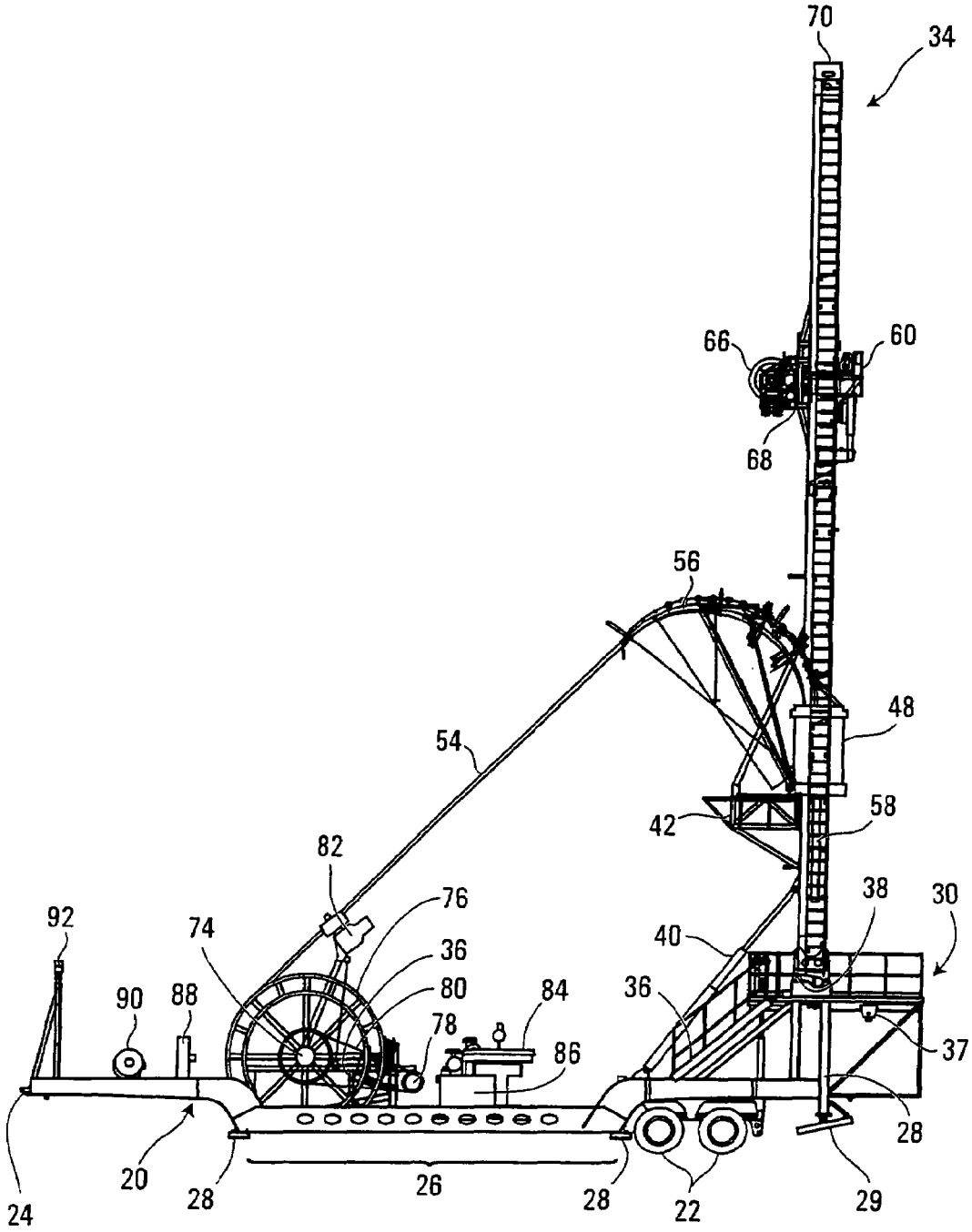
FIG. 6 is a side view of the rig of FIG. 1 shown in CT drilling mode.
Figure 13:
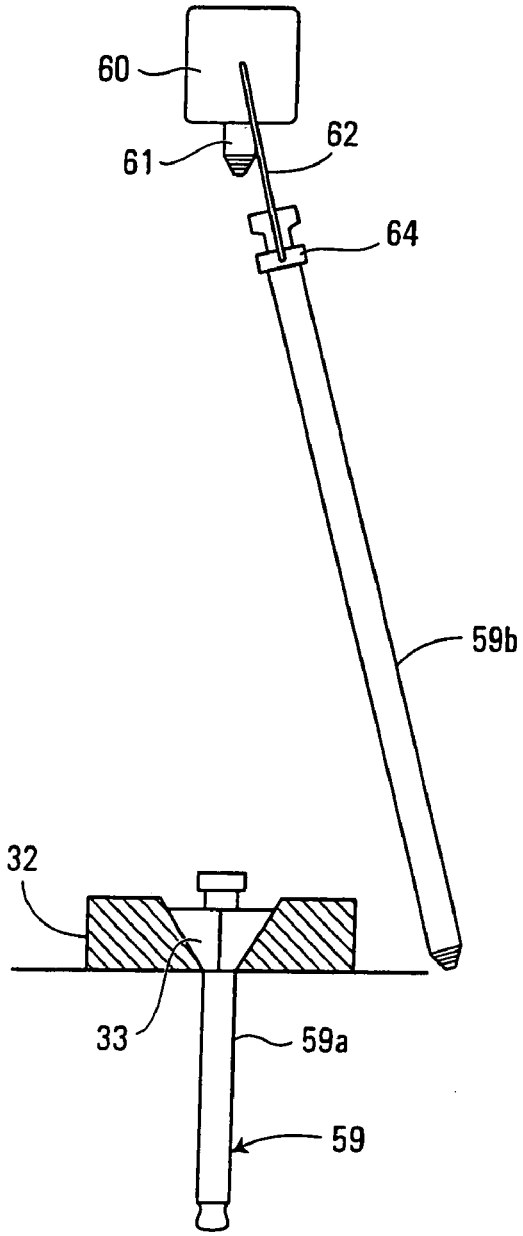
FIG. 13 is a schematic view of the top drive and elevators of the rig of FIG. 1, shown picking up an element of a bottom hole assembly.
Figure 14:
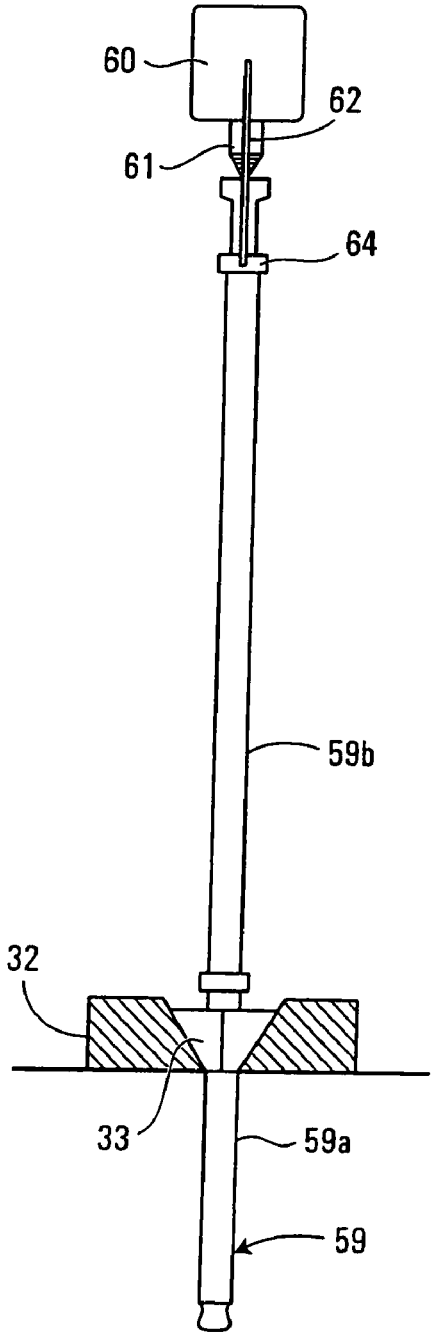
FIG. 14 is a schematic view of the top drive and elevators of the rig of FIG. 1, shown securing the element of FIG. 13 to a lower portion of the bottom hole assembly.

The mast 34 of the preferred embodiment rig is composed in part of square tubing (not shown) running along a substantial portion of the length of the mast 34. Riding along, and slidable on this square tubing is a top drive 60 operable to engage and rotate downhole equipment (which equipment may or may not be in the well when engaged or rotated by the top drive 60) such as jointed-pipe, bottom hole assembly (BHA) elements, etc. As with the coiled tubing injector 48, the structure and functionality of top drives 60 are well known in the field and will not be discussed in detail herein. The top drive 60 of the preferred embodiment rig has on its underside, in line with the mast, a threaded engagement element 61 (FIGS. 13, 14) for threaded engagement with downhole equipment. As shown in FIG. 5, the top drive 60 also has pivotally connected to its underside, a pivotal engagement element consisting of links 62 extending downward, at the ends of which are mounted elevators 64. The links 62 are elongated arms which are pivotally connected to the underside of the top drive 60 by a pin-and-bolt connection. The angle at which the links 62 are situated at a given time is controlled by hydraulic cylinders (not shown) connected to the links 62 and to the body of the top drive 60. The elevators 64 are adapted to engage down-hole equipment such as jointed-pipe 65 (FIG. 5), casing, or BHA elements 59 (FIGS. 13, 14), but to also allow down-hole equipment to pass therethrough when upward force is exerted on the down-hole equipment, so as to engage the threaded engagement element. Typically, such down-hole equipment have a bulge or "tool joint" at their upper ends to accommodate engagement by tools such as elevators 64. FIG. 13 shows elevators 64 engaging the tool joint to pick up an element 59*b* of BHA 59. FIG. 14 shows elevators 64 moving downward relative to BHA element 59*b* as top drive 60 is lowered and BHA element 59*b* is supported on the lower portion 59*a* of BHA 59, which in turn is held by slips 33 in rotary table 32. The function of the links 62, the elevators 64 and the hydraulic cylinders controlling the angle of the links is to allow the top drive 60 to engage downhole equipment which are not necessarily in line with the mast. This feature allows the top drive 60 to pick up downhole equipment from a transport truck, for example, for placement into the well, as discussed further below.

The vertical movement of the top drive 60 along the mast 34 is controlled by a top drive winch 66 mounted on a winch platform 68 (shown in FIG. 10) which itself is mounted on the mast 34 above the injector platform 42. The winch 66 is motorized and winds or unwinds cabling in a controlled manner. This cabling extends from the top drive winch 66 up to the crown 70 of the mast 34, over pulleys 72, and down along the mast to the top drive 60. Thus, by operating the top drive winch 66, the movement of the top drive 60 along the mast 34 is controlled.

Figure 12:
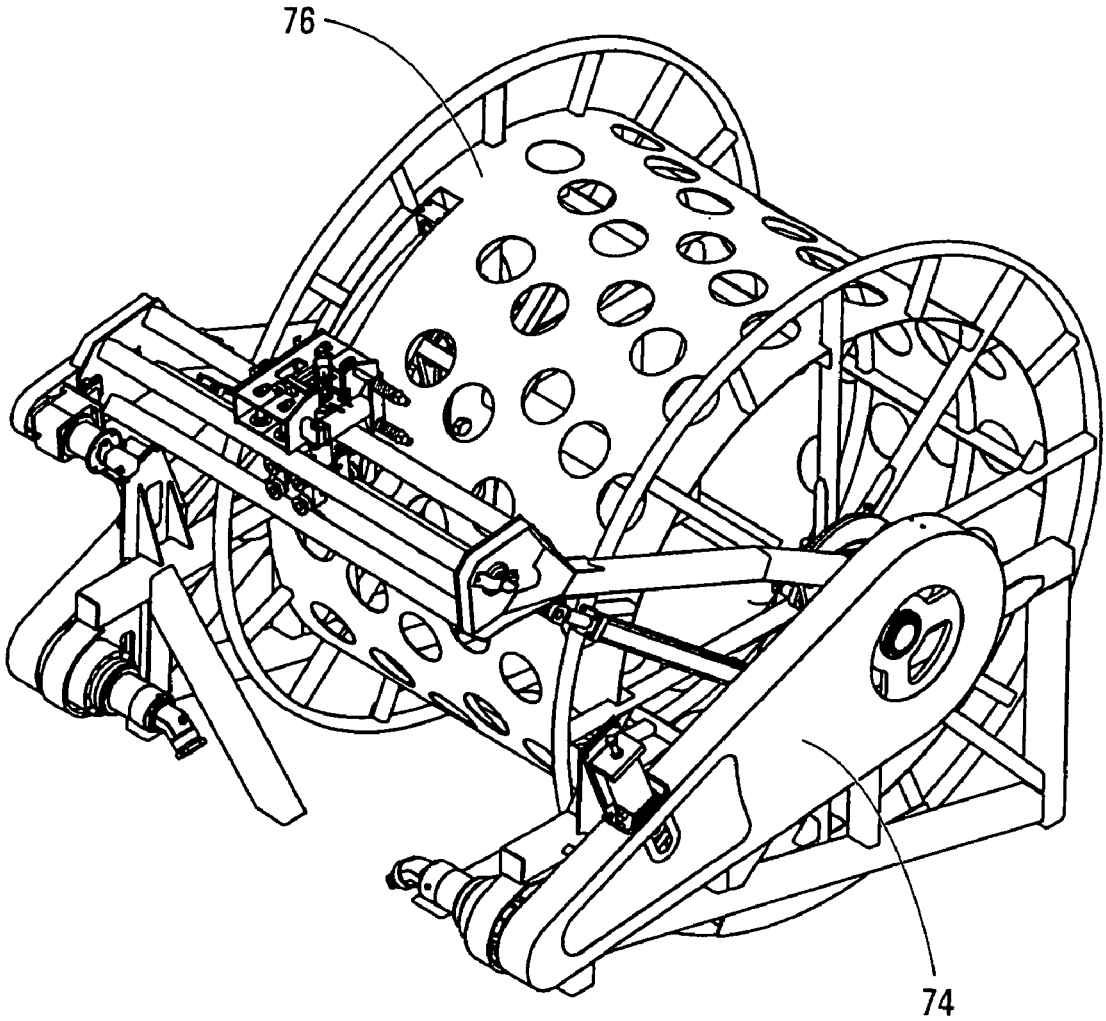
FIG. 12 is a perspective view of a spool of the rig of FIG. 1.

Near the forward end of the lowered middle portion 26 of the trailer 20 is a spindle 74 for mounting a coiled tubing spool 76. The spindle 74 (shown in detail in FIG. 12) consists of a pair of geared U-shaped brackets supported above the bed of the trailer 20. The spindle 74 also has a pair of closures (not shown) to fully engage the coiled tubing spool 76 once it is in place. The coiled tubing spool 76 is a spool having wound thereon coiled tubing 54. The coiled tubing spool 76 is rotated during drilling operations by a spool drive motor 78 connected to the spindle 74 by chains or belts 80. As coiled tubing 54 exits the coiled tubing spool 76 during drilling operations, it is guided and straightened by a coiled tubing guidance system, in this case a level wind 82 projected above the spindle 74. From the level wind 82, the coiled tubing 54 extends up to the injector arch 56. The coiled tubing guidance system also serves to wind the coiled tubing 54 evenly across the coiled tubing spool 76 when the coiled tubing 54 is being rewound back onto the spool 76. In the alternative to a level wind 82 which guides incoming coiled tubing 54 back and forth across the coiled tubing spool 76, the guidance system may also be for example a traversing system which moves the coiled tubing spool 76 itself back and forth.

Also located on the trailer 20 are an engine 84 for providing the power required to operate the various drilling components, a hydraulic tank 86 for storing hydraulic fluids for use in operating the various hydraulic cylinders located on the rig, a hydraulic cooler 88 for cooling the hydraulic fluid, a fuel tank 90 for storage of fuel for the engine 84, and a mast rest 92 located near the front of the trailer 20 extending above the trailer for supporting the mast 34 when the mast 34 is in transportation position.

In the preferred embodiment rig, each of the winch platform 68, the injector platform 42, the spindle 74, as well as the engine 84, hydraulic tank 86, hydraulic cooler 88, fuel tank 90 are located on the trailer 20 and on the mast 34 such that when the mast 34 is lowered into its transportation position such that the mast 34 is substantially horizontal, none of these elements impinges on the other elements.

In operation, the rig is stored and transported with the mast 34 in its transportation position, namely with the mast 34 in a substantially horizontal position. Once a site for a well has been identified, the trailer 20 of the preferred embodiment of the present invention is positioned such that the mast 34 when erected will be in line with the axis of the well to be drilled. When the trailer 20 is in position, the stabilizer legs 28 are extended such that their pontoons engage the ground. The stabilizer legs 28 are then adjusted so as to level the trailer 20. The mast 34 is then erected from its transportation position to its operating position wherein (in the case of the preferred embodiment rig of the present invention) the mast 34 is vertical. If a coiled tubing spool 76 is not already mounted on the spindle 74, one is put in place, and then the coiled tubing 54 is threaded through the level wind 82 up through the injector arch 56 and into the coiled tubing injector 48.

In a typical drilling application, the top drive 60 will then be used to drill a pilot hole using jointed-pipe 65 (FIG. 5). The process of jointed-pipe drilling is well known to those in the relevant field and is not discussed in detail here. The coiled tubing injector 48 is moved to its second position during this procedure, using the injector cylinders (not shown), such that the injector 48 is out of line with the mast 34 to allow the top drive 60 to drill using jointed-pipe 65.

Once a pilot hole has been drilled, casing (not shown) will typically be run into the pilot hole using the top drive 60 and cemented in place. Again, this process is well known to those in the field. The well is then ready for coiled tubing drilling.

The first step in the coiled tubing drilling stage using the preferred embodiment rig of the present invention is to assemble BHA assembly 59 (FIGS. 13, 14) and connect it to the end of the coiled tubing 54. As this preferred embodiment rig is uniquely suited to perform this task in an efficient manner, this procedure will be discussed in some detail.

BHA 59 (FIGS. 13, 14) typically consists of the various elements to be located at the end of the coiled tubing 54 to allow coiled tubing 54 to be used for drilling. Of course BHA 59 may additionally, or alternatively consist of other down-hole equipment such as sensors or samplers used to determine properties of a particular down-hole formation. Typical drilling elements included in a drilling BHA 59 include a bit, a mud motor, drill collars, and survey tools. Each of the BHA elements 59 is typically threaded at its lower and upper ends so as to permit threaded engagement with each other, as well as with the threaded end of the coiled tubing 54.

During the first series of steps, it is necessary for the coiled tubing injector 48 to be placed in its second position in which the injector 48 is out of line with the mast. The top drive 60 is moved to a position near the bottom of the mast 34, but still some distance above the rotary table 32 so as to allow the insertion of BHA elements 59 therebetween.

A bottom element 59*a* of BHA 59 is then positioned such that it is in line with the mast 34 between the rotary table 32 and the top drive 60. Typically, BHA elements 59 are brought to the well site on a transport truck, and BHA elements 59 are placed into position using hydraulic lifting racks, a crane, an auxiliary winch located near the top of the mast 34, or by other suitable means. This bottom element 59*a*of BHA 59 is then moved downward so as to be inserted into the rotary table 32, as shown in FIGS. 13, 14. This first step may also be accomplished using top drive 60 in a manner similar to that described below for the remaining elements of BHA 59. Slips 33 of rotary table 32 are then operated to engage the bottom element 59*a* of BHA 59.

Next, the hydraulic cylinders controlling the angle of the links 62 are operated to push the links out at a suitable angle as shown in FIG. 13, and a second element 59*b* of the BHA 59 is positioned such that its upper end is adjacent to the elevators 64 of the top drive 60. Typically, the second element 59*b* of BHA 59 would be positioned at an angle to the mast 34 at this point, as shown in FIG. 13. The elevators 64 are then operated so as to engage this second element 59*b* of BHA 59. Because the links 62 to which the elevators 64 are mounted are connected to the remainder of the top drive 60 through a pivotal connection, this process of engaging the second element 59*b* of BHA 59 can take place even when the second element 59*b* of BHA 59 is not parallel to the mast 34. If necessary, the top drive 60 is then moved upward using the top drive winch 66 (FIG. 5) to position the second element 59*b* of BHA 59 such that it is in line with the mast 34. The top drive 60 is then lowered until the lower end of the second element 59*b* of BHA 59 is adjacent to the upper end of the bottom element 59*a*, as shown in FIG. 14. By further lowering the top drive 60, the second element 59*b* of BHA 59, is pushed up through the elevators 64, between the links 62, to lie adjacent to the threaded engagement element 61 of the top drive 60. The top drive 60 and/or the rotary table 32 are then operated to allow the top drive 60 to threadedly engage the second element 59*b* of BHA 59, and then to rotate the second element 59*b* of BHA 59 and the bottom element 59*a* of BHA 59 relative to each other so as to threadedly engage the second element 59*b* of BHA 59 with the bottom element 59*a* of BHA 59. Optionally, slips 33 of rotary table 32 may be operated at this point to release bottom element 59*a*, the top drive 60 may be moved down the mast 34 such that the second element 59*b* is inserted into the rotary table 32, and then slips 33 of rotary table 32 may be operated to engage the second element 59*b* of BHA 59. The top drive 60 is then operated to disengage from the second element 59*b* of BHA 59.

The steps in the above paragraph are then repeated for the remaining elements of BHA 59. When the final element of BHA 59 has been screwed into the BHA, slips 33 of rotary table 32 typically release BHA 59, and the top drive 60 moves BHA 59 partly into the well. The slips 33 of rotary table 32 then engage BHA 59 again, and the top drive 60 disengages from the BHA.

The top drive 60 is then moved to a location above the coiled tubing injector 48 so as to move it out of the way. The lubricator winch 52 is then operated to retract the lubricator 58, and the coiled tubing injector 48 is moved to its first position wherein the injector 48 is in line with the mast 34. Next, the coiled tubing injector 48 is operated to move coiled tubing 54 to a position such that its threaded end is adjacent to the upper end of BHA 59. The rotary table 32 is then operated to rotate BHA 59 relative to the coiled tubing so as to connect the two in threaded engagement, and the lubricator 58 is extended.

Finally, slips 33 of rotary table 32 release BHA 59, and the coiled tubing injector 48 is operated to drill the well.

When necessary to switch from coiled tubing operations to jointed-pipe operations, the coiled tubing 54 is extracted from the well such that BHA 59 is suspended below the coiled tubing injector 48. The coiled tubing injector 48 is then moved to its second position in which the injector 48 is out of line with the mast, so as to allow the top drive 60 to perform jointed-pipe operations.

When necessary to switch from jointed-pipe operations to coiled tubing operations, the jointed-pipe 65 (FIG. 5) is extracted from the well and moved out of the mast. The coiled tubing injector 48 is then moved to its first position in which the injector 48 is in line with the mast so as to be in a position to perform coiled tubing operations.

It is to be understood that the precise steps and the precise order of these steps do not need to be exactly as described above for the operation of the preferred embodiment rig of the present invention. Steps may be reordered, steps may be omitted, or other steps may be inserted without necessarily departing from the method of the present invention.

It is further to be understood that the particular configuration of the various components of the rig, and their relative location need not necessarily be exactly as described above.

It is also to be understood that the drilling rig of the present invention may also be used to set casing using the top drive once drilling has been completed. The rig can also be used for drill stem testing using the top drive and jointed-pipe.

Numerous modifications and variations of the present invention are possible in light of the above teachings. It is therefore to be understood that within the scope of the appended claims, the invention may be practised otherwise than as specifically described herein.

The invention claimed is:

1. A rig for drilling a well comprising:

a base;

a mast mounted on said base;

a top drive operable to engage and rotate downhole equipment, slidably mounted on said mast for longitudinal sliding along said mast; and a coiled tubing injector operable to move coiled tubing in and out of said well, supported on said mast.

2. The rig of claim 1 wherein the coiled tubing injector is movably supported on said mast such that it may be moved to and parked at a position which accommodates longitudinal sliding of the top drive along said mast.

3. The rig of claim 1 wherein the coiled tubing injector is slidably mounted on said mast for longitudinal sliding along said mast.

4. The rig of claim 1 wherein the top drive is in line with the mast during coiled tubing operations.

5. The rig of claim 4 wherein the coiled tubing injector is movably supported on said mast such that it may be moved to and parked at a position which accommodates longitudinal sliding of the top drive along said mast.

6. The rig of claim 1 wherein a lower portion of the mast below the coiled tubing injector is free of the top drive during coiled tubing operations.

7. The rig of claim 1 wherein the coiled tubing injector is supported on the mast such that during at least part of the drilling operation, the coiled tubing injector is out of line with the mast.

8. The rig of claim 1 wherein during top drive operations, the coiled tubing injector is supported on the mast out of line with the mast.

9. The rig of claim 8 wherein said coiled tubing injector is in a fixed position along the length of said mast.

10. The rig of claim 1 wherein the rig is adapted to perform drilling operations with the mast positioned off-vertical.

11. The rig of claim 10 wherein the rig is adapted to perform coiled tubing operations with the mast positioned off-vertical.

12. The rig of claim 10 further comprising tilt-control means for controlling the angle of the mast.

13. The rig of claim 10 wherein the coiled tubing injector is supported on the mast such that during at least part of the drilling operation, the coiled tubing injector is out of line with the mast.

14. A mobile rig for drilling a well comprising:

a mast;

a top drive operable to engage and rotate downhole equipment, slidably mounted on said mast when the rig is in its operating position, for longitudinal sliding along said mast;

a coiled tubing injector operable to move coiled tubing in and out of said well, supported on said mast when the rig is in its operating position, said mast, said top drive and said coiled tubing injector supported on at least one wheeled trailer when the rig is in its transportation position.

15. The rig of claim 14 further comprising a coiled tubing spool supported on said at least one wheeled trailer.

16. The rig of claim 15 wherein the spool is supported on said at least one wheeled trailer for relative movement therebetween so as to place the spool in a position suitable for effective winding and unwinding of coiled tubing on said spool when the rig is operating.

17. The rig of claim 16 wherein the spool is supported on said at least one wheeled trailer for reciprocal movement of the spool relative to the wheeled trailer, along an axis of the spool.

18. The rig of claims 1, 2, 3, 4, 6, 7, 8, 10 or 14 wherein said rig is adapted to selectively drill using coiled tubing and jointed-pipe.

19. A method of drilling a well using coiled tubing and jointed-pipe comprising:

providing a base;

providing a mast mounted on said base;

providing a top drive operable to engage and rotate downhole equipment, slidably mounted on said mast for longitudinal sliding along said mast;

providing a coiled tubing injector operable to move coiled tubing in and out of said well, supported on said mast;

selectively using the top drive to perform jointed-pipe drilling operations; and selectively using the coiled tubing injector to perform coiled tubing drilling operations.

20. The method of claim 19 wherein the coiled tubing injector is movably supported on said mast and the step of selectively using the top drive comprises moving the coiled tubing injector to and parking it at a position which accommodates longitudinal sliding of the top drive along said mast.

21. The method of claim 19 wherein the coiled tubing injector is also slidably mounted on said mast for longitudinal sliding along said mast.

22. The method of claim 19 further comprising maintaining the top drive in line with the mast during the step of selectively using the coiled tubing injector.

23. The method of claim 22 wherein the coiled tubing injector is movably supported on said mast and the step of selectively using the top drive comprises moving the coiled tubing injector to and parking it at a position which accommodates longitudinal sliding of the top drive along said mast.

24. The method of claim 19 further comprising maintaining a lower portion of the mast below the coiled tubing injector free of the top drive during the step of selectively using the coiled tubing injector.

25. The method of claim 19 further comprising maintaining the coiled tubing injector out of line with the mast during at least part of the drilling operations.

26. The method of claim 19 further comprising maintaining the coiled tubing injector out of line with the mast while selectively using the top drive.

27. The method of claim 26 further comprising maintaining the coiled tubing injector in a fixed position along the length of said mast.

28. The method of claim 19 further comprising performing drilling operations with the mast positioned off-vertical.

29. The method of claim 28 further comprising selectively using the coiled tubing injector with the mast positioned off-vertical.

30. The method of claim 28 further comprising providing tilt-control means for controlling the angle of the mast.

31. The method of claim 28 further comprising maintaining the coiled tubing injector out of line with the mast during at least part of the drilling process.

32. A method of transporting a mobile rig for drilling a well comprising:

providing a rig comprising a mast, a top drive operable to engage and rotate downhole equipment, slidably mounted on said mast when the rig is in its operating position, for longitudinal sliding along said mast, and a coiled tubing injector operable to move coiled tubing in and out of said well, supported on said mast when the rig is in its operating position;

placing said rig in its transportation position; and supporting said rig on at least one wheeled trailer.

33. The method of claim 32 further comprising providing a coiled tubing spool, and supporting said spool on said at least one wheeled trailer.

34. The method of claim 33 further comprising supporting said spool on said at least one wheeled trailer for relative movement therebetween and moving said spool to a position suitable for effective winding and unwinding of coiled tubing on said spool when the rig is in operation.

35. The method of claim 34 further comprising supporting said spool on said at least one wheeled trailer for reciprocal movement of the spool relative to the wheeled trailer, along an axis of the spool.

* * * * *